United States Patent [19]

Eckman

[11] 4,375,801

[45] Mar. 8, 1983

[54] CHARGE MIXING CARBURETOR PLATE

[76] Inventor: Donald E. Eckman, P.O. Box 10582, Erie, Pa. 16514

[21] Appl. No.: 307,521

[22] Filed: Oct. 1, 1981

[51] Int. Cl.[3] ..... F02M 29/00

[52] U.S. Cl. ..... 123/590; 48/180 R; 261/79 R

[58] Field of Search ..... 123/590; 261/79 R; 48/180 R

[56] References Cited

U.S. PATENT DOCUMENTS

| | | | |
|---|---|---|---|
| Re. 24,291 | 12/1961 | Goodyer . | |
| Re. 28,616 | 11/1975 | Yankura . | |
| 1,244,379 | 10/1917 | Short | 123/590 |
| 2,152,206 | 3/1939 | Neal | 48/180 R |
| 2,618,541 | 11/1952 | Aleman et al. | 48/180 R |
| 2,792,291 | 5/1957 | Malouf | 48/180 R |
| 2,822,253 | 2/1958 | Caddock | 48/180 R |
| 3,085,869 | 4/1963 | Benes | 123/591 |
| 3,332,231 | 7/1967 | Walsh . | |
| 3,334,657 | 8/1967 | Smith et al. . | |
| 3,393,984 | 7/1968 | Wisman . | |
| 3,399,245 | 8/1968 | Knapp . | |
| 3,405,917 | 10/1968 | Hecht . | |
| 3,437,467 | 4/1969 | Jacobus | 48/180 R |
| 3,449,098 | 6/1969 | Larson, Sr. . | |
| 3,467,072 | 9/1969 | Toesca . | |
| 3,499,427 | 4/1970 | August . | |
| 3,605,942 | 9/1971 | Lyth . | |
| 3,607,155 | 9/1971 | Faltermeier | 48/180 R |
| 3,635,201 | 1/1972 | High | 261/79 R |
| 3,667,221 | 6/1972 | Taylor . | |
| 3,707,278 | 12/1972 | Landrum | 48/180 R |
| 3,747,581 | 7/1973 | Kolb . | |
| 3,799,514 | 3/1974 | Braden . | |
| 3,847,125 | 11/1974 | Malherbe | 123/591 |
| 3,851,634 | 12/1974 | Everett . | |
| 3,868,936 | 3/1975 | Rivere . | |
| 3,917,758 | 11/1975 | Huff . | |
| 3,955,545 | 5/1976 | Priegel | 261/50 R |
| 4,015,574 | 4/1977 | Hanff . | |
| 4,019,476 | 4/1977 | Ackley . | |
| 4,058,102 | 11/1977 | Fabritz . | |
| 4,063,905 | 12/1977 | Johnson et al. . | |
| 4,078,532 | 3/1978 | Smith . | |
| 4,086,899 | 5/1978 | Gaylord . | |
| 4,088,104 | 5/1978 | Ibbott . | |
| 4,100,905 | 7/1978 | Nolan . | |
| 4,109,619 | 8/1978 | Morris | 123/52 M |
| 4,114,580 | 9/1978 | Coats . | |
| 4,148,285 | 4/1979 | Ahlers . | |
| 4,153,029 | 5/1979 | Ikegaya . | |
| 4,163,436 | 8/1979 | Fugett . | |
| 4,177,780 | 12/1979 | Pellerin | 261/79 R |
| 4,192,273 | 3/1980 | Gray | 13/52 M |
| 4,215,663 | 8/1980 | Gaylord | 123/590 |
| 4,263,233 | 4/1981 | Fenn . | |
| 4,274,386 | 6/1981 | Reyes | 123/591 |

FOREIGN PATENT DOCUMENTS

| | | |
|---|---|---|
| 639205 | 6/1928 | France . |

*Primary Examiner*—Charles J. Myhre
*Assistant Examiner*—E. Rollins Cross
*Attorney, Agent, or Firm*—Stevens, Davis, Miller & Mosher

[57] ABSTRACT

A device for mixing and atomizing the fuel-air flow which is positioned between the carburetor and the intake of an internal combustion engine. The device comprises a swirl chamber which creates turbulence in the fuel-air flow by turning a portion of the flow upstream into the downward flow going to the engine intake and has a trough which collects liquid fuel droplets which have landed on the swirl chamber wall. The liquid fuel collected in the trough is vaporized by the heat of the engine and then re-enters the fuel-air flow.

9 Claims, 2 Drawing Figures

CHARGE MIXING CARBURETOR PLATE

BACKGROUND OF THE INVENTION

The present invention relates to a charge mixing device for an internal combustion engine which mixes and atomizes the air-fuel mixture before it enters the combustion chambers.

Atomization of combustion fuel into small droplets produces a mist which can be more uniformly mixed with combustion air. The resultant uniform fuel and air mixture improves the efficiency of engine operation because the liquid surface area of the mass fuel flow is increased, thus allowing much faster and more complete vaporization of the fuel.

Atomization of liquid fuel beyond the amount realized from a standard carburetor enables easier starting, leaner and shorter duration of choke settings, and satisfactory cold drive-aways, all of these attributes being attained with lean mixture settings. Where the combustion fuel is properly atomized, the correct combustion air-fuel mixture is quickly achieved upon initial cranking of the engine. Improved atomization enables leaner mixtures to be utilized because the improved mixture promotes more complete combustion of the fuel and air, whereas non-homogenous fuel and air mixtures cause erratic combustion of the reactants which in turn cause increased objectionable exhaust emissions.

SUMMARY OF THE INVENTION

The present invention comprises a carburetor plate placed between the carburetor and engine intake. The carburetor plate has a swirl chamber directly under each carburetor barrel. The flow from the carburetor barrel passes through the combustion mixer intake into the swirl chamber where a portion of the flow is directed radially outwardly into the swirl chamber and follows the contour of the swirl chamber down to the lip on the bottom of the carburetor plate, at which point it is turned upward and into the downward flow going through the exhaust throat and into the engine intake. As the upward flow from the swirl chamber lip and the downward flow passing directly to the exhaust throat collide, turbulence is created in and above the exhaust throat which atomizes the combustion mixer to improve the mixing of the combustible mixture. Further, fuel droplets which enter the carburetor plate have a tendency to collect at the bottom of the annular trough in the carburetor plate as the combustible gas is turned upwards at the lip. The liquid gas collected in the annular trough is heated by the hot carburetor plate and vaporized. It then re-enters the flow and passes over the lip through the exhaust throat to the intake.

DESCRIPTION OF THE PREFERRED EMBODIMENTS

Figure 1:
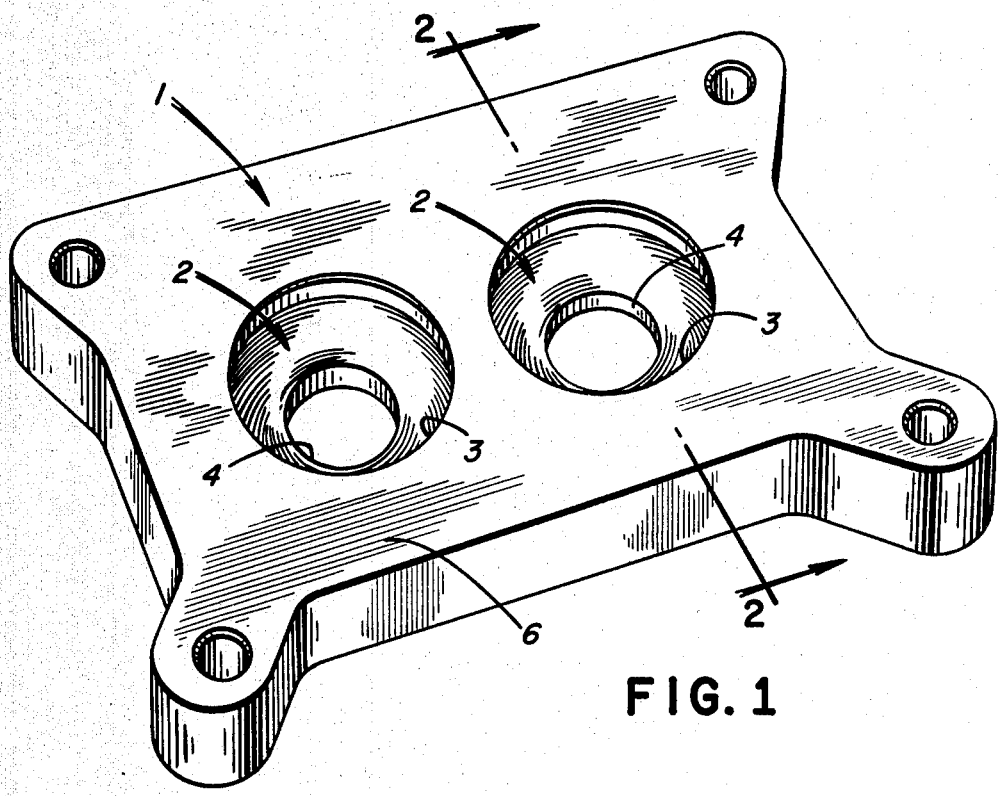
FIG. 1 is a top perspective view of the carburetor plate.
Figure 2:
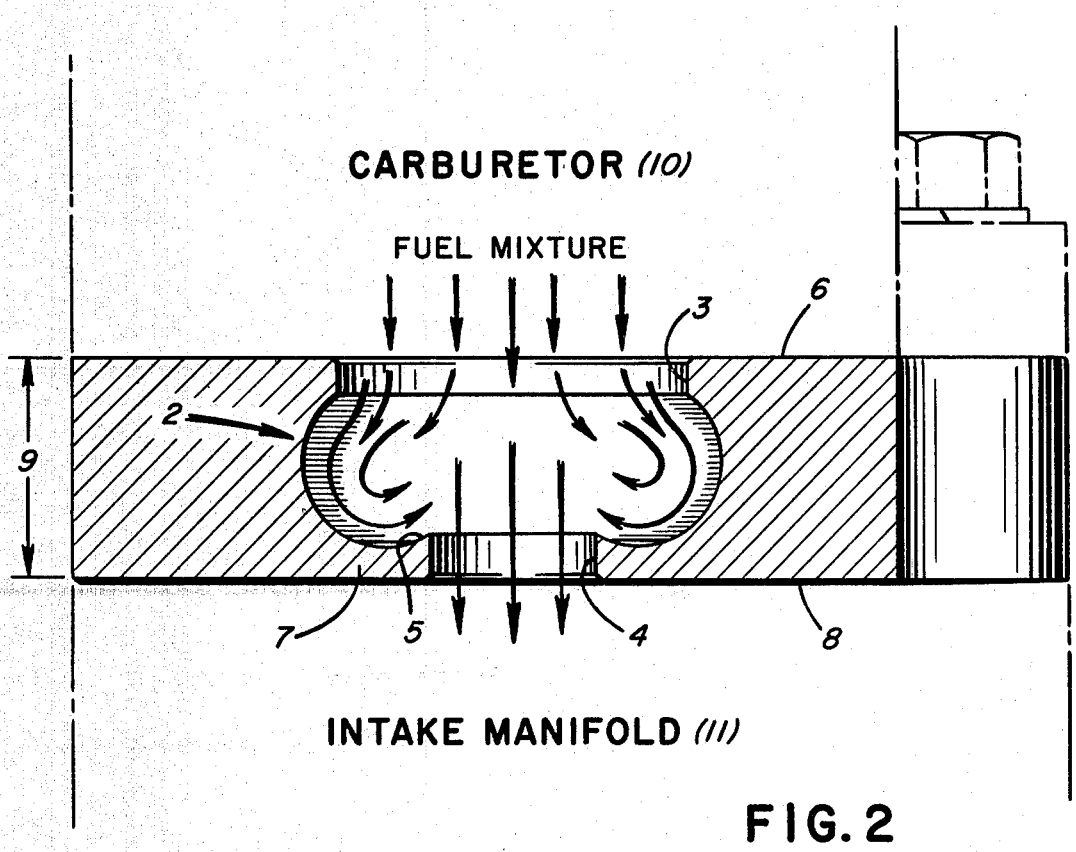
FIG. 2 is a cross-sectional view taken along the line 2—2 of FIG. 1.

The carburetor plate 1 is secured between the carburetor 10 and intake 11 of an internal combustion engine. The material of which the carburetor plate 1 is made needs only to be structurally rigid and heat conductive.

Aluminum is an especially good material since it fulfills the requirements and is easy to machine.

Directly under and coaxial with each carburetor barrel (not shown) is a swirl chamber 2. The entrance throat 3 to the swirl chamber preferably has the same diameter as the lower portion of the carburetor barrel. The exhaust throat 4 is also coaxial with the entrance throat, but it has a substantially smaller diameter than the entrance throat 3.

The swirl chamber 2 resembles an inverted cardioid, or heart shaped curve, which has been rotated about its axis to form a volume and a large hole, the entrance throat 3 cut out of its top, and a smaller hole, the exhaust throat 4, cut out of its bottom. The entrance throat 3 and the exhaust throat 4 are cylindrical between the edge of the carburetor plate and the cardioid shaped swirl chamber 2. The carburetor plate 1 has a sufficient thickness 9 so as to enclose all of the swirl chambers 2 between its top 6 and bottom 8. Both the top 6 and bottom 8 are planar so as to be capable of forming an airtight seal with the carburetor 10 bottom and the intake 11 top, respectively. The lip 5 in the bottom of the swirl chamber 2 forms a volcano shaped flow ramp which turns the flow following the contour of the swirl chamber 2 up into the downwardly flowing flow passing through the exhaust throat 4. Since the lip 5 turns the direction of the gas flow, it must have a smooth and gradually turning profile so the flow will follow its profile and be turned upwards.

The lip 5 also forms one side of an annular trough 7 at the bottom of the swirl chamber 2. The annular trough 7 collects liquid gas droplets which collect on the swirl chamber wall. Also, the fuel droplets, which are heavier than the charge gases, drop out into the trough as the flow is turned upwards by the lip. The bottom of the swirl chamber 2 is adjacent to the hot engine intake. Thus, some of the heat from the intake is transferred up through the bottom of the carburetor plate 1 into the liquid gas collected in the annular trough 7. Consequently, the liquid gas is vaporized and re-enters the flow within the swirl chamber 2.

In operation, the fuel-air mixture from the carburetor enters the top of the swirl chamber 2 through the entrance throat 3. Some of the fuel-air mixture follows along the sides of the swirl chamber 2 and is turned upwards by the lip 5. Turbulence is created as the downward flow going through the center of the swirl chamber collides with the upward flow coming from the lip 5.

The turbulence in the swirl chamber 2 increases the uniformity of the air-fuel mixture and atomizes the fuel droplets in the flow. Further, the turbulence turns a great deal of the flow towards and into the sides of the swirl chamber 2 which effectively causes liquid fuel droplets to hit the wall of the swirl chamber and either collect in the annular trough 7 or be broken up into smaller particles before bouncing off the wall back into the flow. The liquid fuel which collects in the trough 7 is vaporized and then re-enters the flow, as a gas instead of a liquid. Thus, the net effect of the swirl chamber is to either vaporize or atomize the liquid-fuel droplets and increase the uniformity of the fuel-air flow before the flow enters the combustion chamber. Both of the effects increase the combustability of the fuel-air flow and hence the efficiency of combustion.

While I have described and shown a particular embodiment (the best mode) of my invention, it will be understood that many modifications may be made without departing from the spirit thereof, and I contemplate by the appended claims to cover any modifications within the true spirit and scope of my invention.

What is claimed is:

1. A swirl chamber between a carburetor barrel and a combustion chamber in an internal combustion engine, said swirl chamber having a substantially cardioid shape in cross section and being substantially symmetrical about its axis, said swirl chamber comprising:

an entrance throat at the top of said swirl chamber nearest to the carburetor;

an exhaust throat at the bottom of said swirl chamber nearest to the combustion chamber, said exhaust throat having a smaller underlying perimeter than said entrance throat and being disposed directly beneath said entrance throat, and being in direct fluid communication with said entrance throat;

a lip at the bottom of said swirl chamber extending radially outwardly from the perimeter of said exhaust throat formed to direct vapor flow upwards toward said entrance throat; and an annular trough extending radially outwardly from the lip.

2. A swirl chamber as claimed in claim 1, wherein the perimeters of said entrance throat and said exhaust throat are substantially circular.

3. A swirl chamber as claimed in claim 1 wherein said swirl chamber is enclosed within a carburetor plate and said entrance throat extends to the top of said carburetor plate and the exhaust throat extends to the bottom of said carburetor plate.

4. A swirl chamber as claimed in claim 3 wherein said entrance throat and said exhaust throat are substantially cylindrical between the edge of the carburetor plate and the cardioid shaped swirl chamber.

5. A swirl chamber as claimed in claims 2 or 4 wherein said swirl chamber is formed of a structurally rigid and heat conductive material.

6. A swirl chamber as claimed in claim 5 wherein an airtight seal is formed between the carburetor plate and the combustion chamber.

7. A swirl chamber as claimed in claim 6 wherein said lip has a smooth and gradually turning profile.

8. A swirling device for use in an internal combustion engine having an upper portion to be disposed nearest to the carburetor of the engine and a lower portion to be disposed nearest to the combustion chamber of the engine, comprising:

an entrance throat in the upper portion of the swirling device;

an exhaust throat in the lower portion of the swirling device directly and completely beneath said entrance throat and having a smaller perimeter than said entrance throat, in direct fluid communication with said entrance throat;

an intermediate portion disposed between said entrance and exhaust throats to fluidly connect said entrance and exhaust throats, having a vertical cross-sectional shape which is substantially cardioidal and which is substantially symmetrical about its vertical axis;

a lip at the bottom of said intermediate portion, extending radially outwardly from the perimeter of said exhaust throat, formed to direct vapor flow upwards toward said entrance throat; and an annular trough extending radially outwardly from said lip.

9. A swirling device for use in an internal combustion engine, having an upper portion to be located nearest the carburetor of said engine and a lower portion to be located nearest the combustion chamber of said engine, comprising:

an entrance throat in the upper portion of said swirling device;

an exhaust throat in the lower portion of said swirling device directly and completely beneath said entrance throat and having a smaller perimeter than said entrance throat, in direct fluid communication with said entrance throat;

a smooth-surfaced intermediate portion between said entrance and exhaust throats to fluidly connect said entrance and exhaust throats, having a vertical cross-sectional shape substantially cardioidal and substantially symmetrical about its vertical axis;

a lip at the bottom of said intermediate portion, extending radially outwardly from the perimeter of said exhaust throat, formed to direct vapor flow upwards toward said entrance throat; and an annular trough extending radially outwardly from said lip.

* * * * *